US010099505B2

(12) United States Patent
Yoon

(10) Patent No.: US 10,099,505 B2
(45) Date of Patent: Oct. 16, 2018

(54) ASSEMBLY STRUCTURE OF WRITING INSTRUMENT

(71) Applicant: MORRIS CORPORATION, Inchon-si (KR)

(72) Inventor: Hyun-son Yoon, Yongin-si (KR)

(73) Assignee: MORRIS CORPORATION, Inchon-si (KR)

( * ) Notice: Subject to any disclaimer, the term of this patent is extended or adjusted under 35 U.S.C. 154(b) by 0 days.

(21) Appl. No.: 15/423,333

(22) Filed: Feb. 2, 2017

(65) Prior Publication Data

US 2018/0215193 A1 Aug. 2, 2018

(51) Int. Cl.

| | |
|---|---|
| ***B43K 7/12*** | (2006.01) |
| ***B43K 24/00*** | (2006.01) |
| ***B43K 23/00*** | (2006.01) |
| ***B43K 24/08*** | (2006.01) |
| ***B43K 8/02*** | (2006.01) |
| ***B43K 8/24*** | (2006.01) |

(52) U.S. Cl.
CPC ..... *B43K 24/00* (2013.01); *B43K 8/028* (2013.01); *B43K 8/24* (2013.01); *B43K 23/00* (2013.01); *B43K 24/08* (2013.01)

(58) Field of Classification Search
CPC ..... B43K 24/08; B43K 8/028; B43K 8/24
USPC ..... 401/107, 108
See application file for complete search history.

(56) References Cited

U.S. PATENT DOCUMENTS 6,981,812 B1 * 1/2006 Hsieh ..... B43K 8/028 401/107
7,220,073 B2 * 5/2007 Yoon ..... B43K 8/003 401/107
8,348,536 B2 * 1/2013 Yoon ..... B43K 8/003 401/108
8,834,051 B2 * 9/2014 Yoon ..... B43K 8/003 401/107
9,179,757 B2 * 11/2015 Mathiez ..... A45D 40/264

FOREIGN PATENT DOCUMENTS

| | | |
|---|---|---|
| KR | 20-0438707 | 2/2008 |
| KR | 10-0817202 | 3/2008 |

OTHER PUBLICATIONS

Japanese Office Action issued in corresponding Japanese Application No. 2017-022781 dated Dec. 5, 2017 (9 pages).

* cited by examiner

*Primary Examiner* — Jennifer C Chiang
(74) *Attorney, Agent, or Firm* — Staas & Halsey LLP

(57) ABSTRACT

An assembly structure of a writing instrument, in which a sealing module assembly having a pre-assembled module for sealing is detachably attached to a body of the writing instrument, such that a production process may be smoothly performed due to an assembly process of the sealing parts with a difficulty in assembling being previously performed, and defective parts may be separately processed when defects occur in each part due to the separation structure of the body and the sealing module assembly, thereby reducing a defective rate. The assembly structure of a writing instrument, including: a body including a knock part installed therein to be operated by pushing, and a cartridge inserted into a hollow inside thereof; and a sealing module assembly which is detachably attached to a front end of the body, and has modules for sealing and operating installed inside thereof.

3 Claims, 5 Drawing Sheets

- - RELATED ART - -
[FIG. 1]
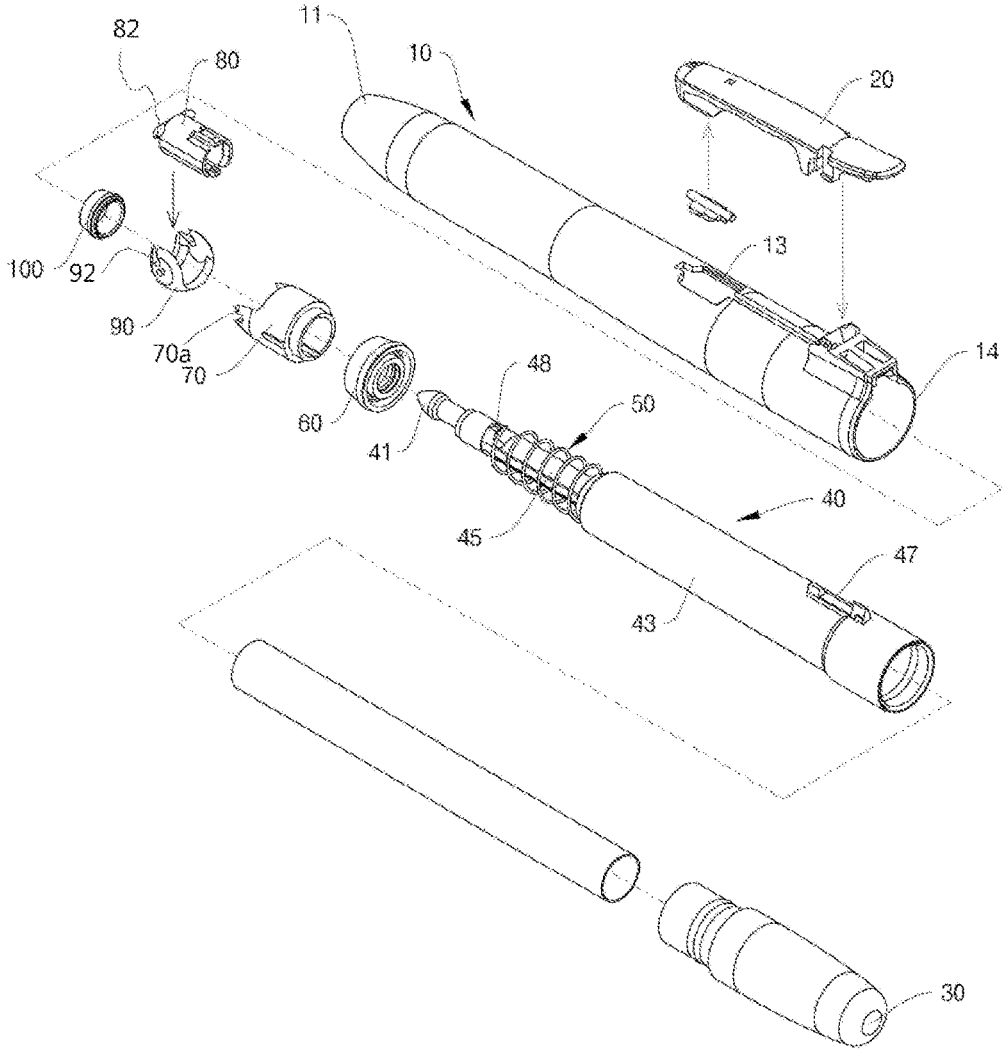

[FIG. 2]
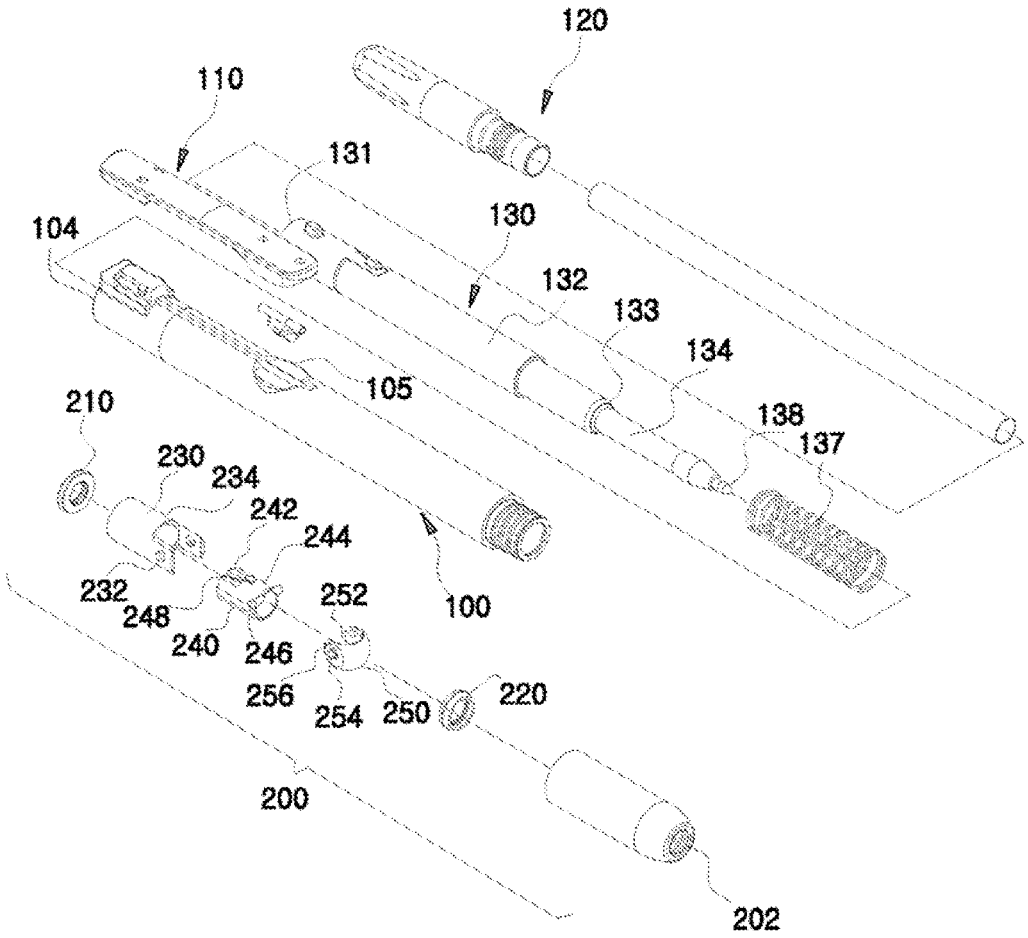

[FIG. 3]
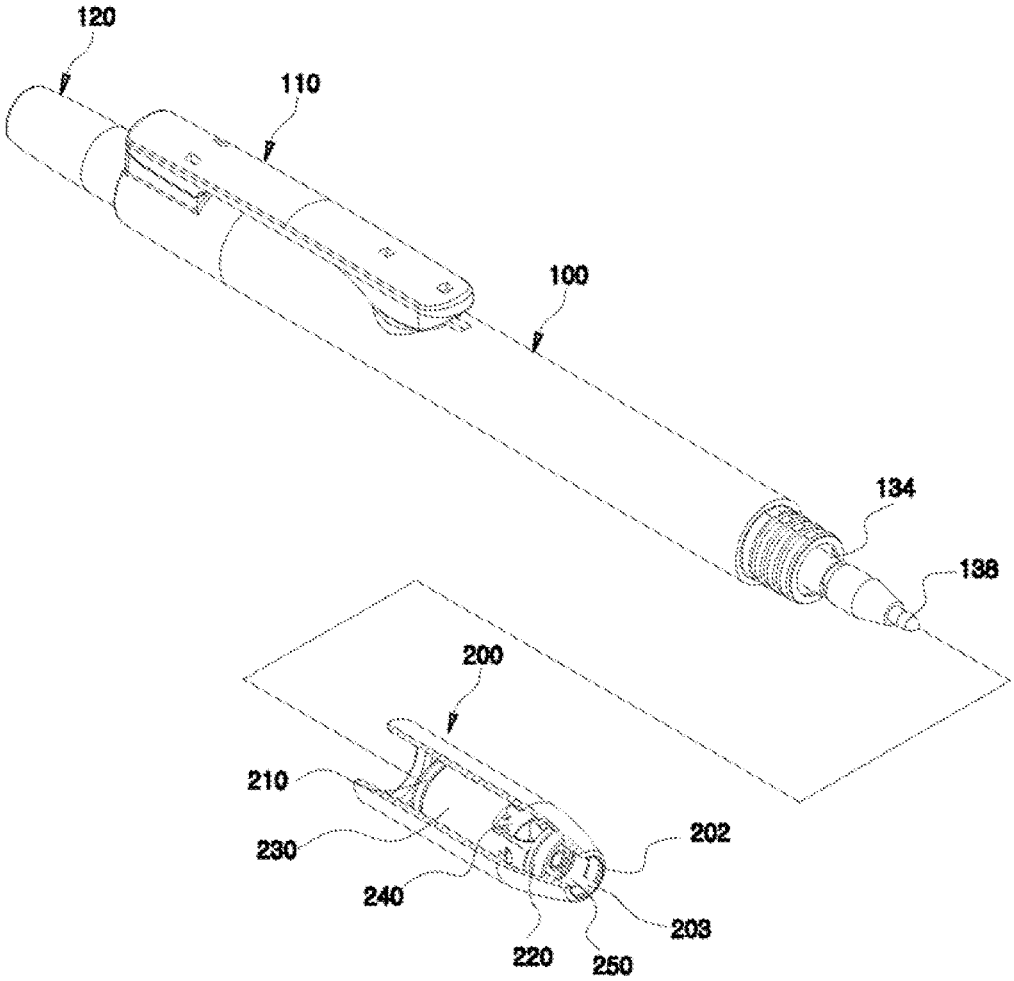

[FIG. 4]
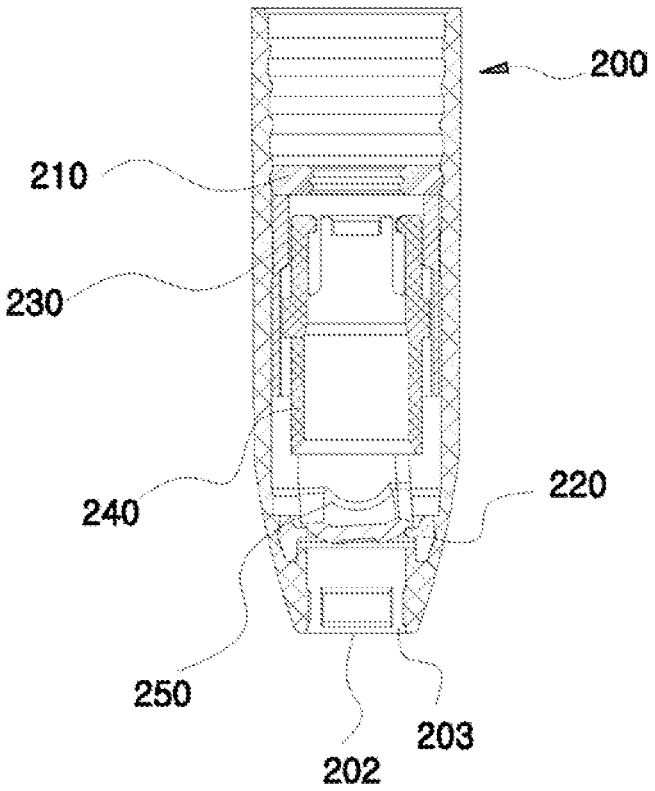

[FIG. 5]
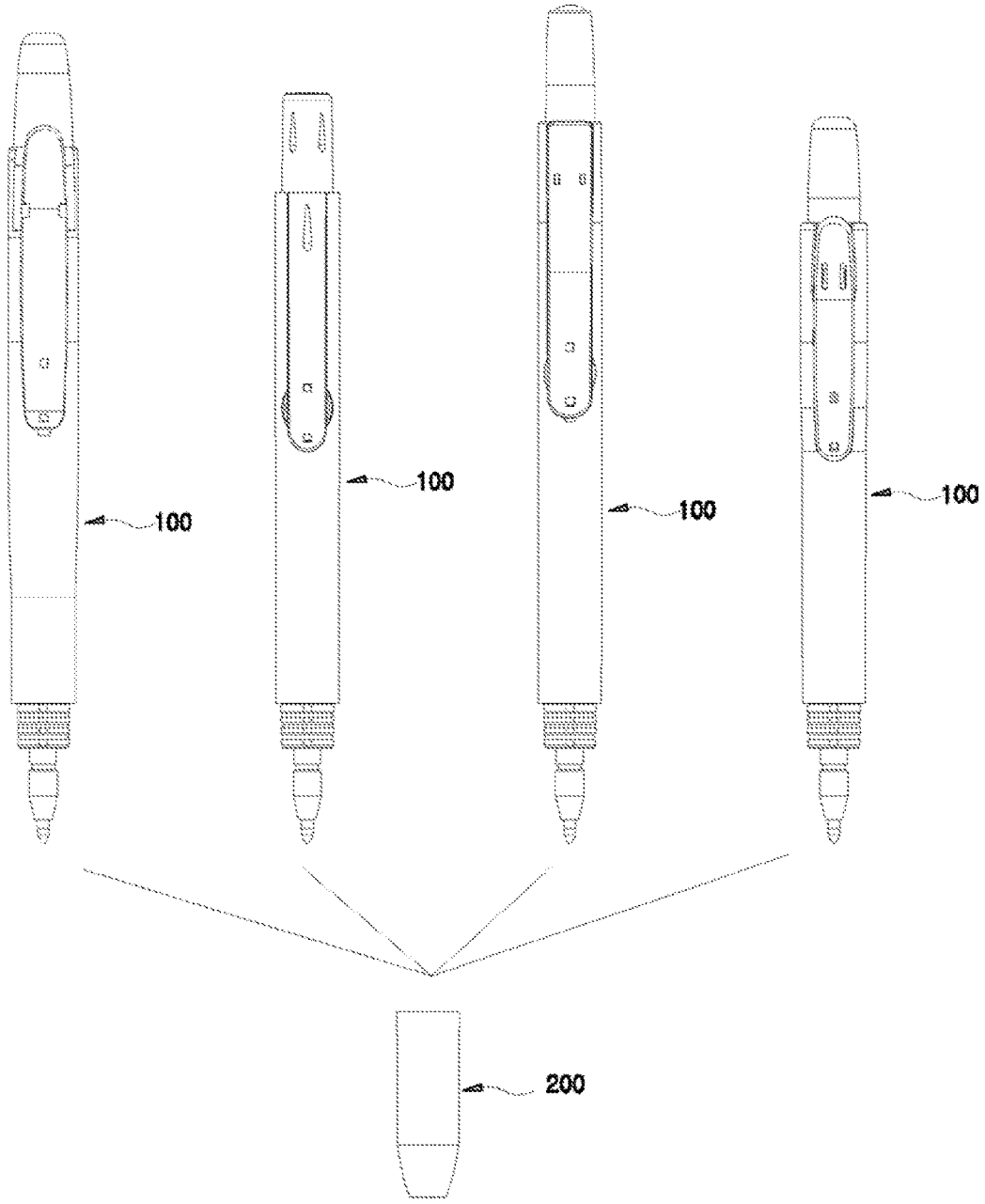

ASSEMBLY STRUCTURE OF WRITING INSTRUMENT

BACKGROUND OF THE INVENTION

1. Field of the Invention

The present invention relates to an assembly structure of a writing instrument, and more particularly, to an assembly structure of a writing instrument including writing instruments such as a ballpoint pen, highlighter, roller pen, board marker pen, oil-based marker pen, magic pen, plastic pen, or marking pen.

2. Description of the Related Art

Typically, a writing instrument is used to record information on a surface using a recording medium, and has various forms and methods such as a ballpoint pen, highlighter, roller pen, board marker pen, oil-based marker pen, magic pen, plastic pen, or marking pen. Most of these types of writing instruments are generally retractable type writing instruments which are provided with a cylindrical body, a nib housed in the body, and a pushing member provided in the body so as to press the nib.

As a prior art of an example of such a writing instrument, there is a "retractable type writing instrument having a drying prevention unit" as disclosed in Korean Patent Registration No. 10-0817202 (published on Mar. 23, 2008), which has been filed and registered by the present applicant.

The "retractable type writing instrument having a drying prevention unit" is a retractable type writing instrument provided with a drying prevention unit for preventing a nib 41 from becoming dry out, and includes: as illustrated in FIG. 1, a knock part 30 coupled to a shaft 10 having a front opening 11 formed in one end thereof so as to make the nib 41 protrude therefrom or be retracted therein; a cartridge 40 inserted into the shaft 10 in a state in which the knock part 30 and the nib 41 are coupled to both ends thereof; a spring 50 installed within the shaft 10 so as to allow the cartridge 40 to return to its original position by an elastic restoring force thereof; an O-ring 60 supported by the spring 50 and fixedly fitted in the shaft 10; a holder 70 fixedly fitted in the shaft so that one end thereof is covered by the O-ring 60; a link 80 which is slidably fitted in the holder 70 and has a plurality of elastic lugs 85 formed at one end thereof, which move up and down along the holder 70 within a predetermined movement range, wherein the elastic lug 85 is locked to a step 48 of the cartridge 40 by a locking part formed at an end thereof; and a ball type door 90 connected to the link 80 by inserting a parallel pin 82 formed at the other end thereof into a pin slit 92 formed therein. When the cartridge 40 and the link 80 are moved forward from the fixed O-ring 60 and the holder 70 by pushing the knock part 30, the parallel pin 82 moves the pin slits 92 of the ball type door 90, and thereby the ball type door 90 is rotated about a pivot shaft 93 which is supported by spherical parts 70*a* to open the inside of the shaft. In this state, the nib 11 protrudes from the front opening of the shaft.

Herein, as illustrated in FIG. 1, for assembling the writing instrument, the cartridge 40, the link 80, the ball-type door 90, and the like are sequentially inserted into a rear opening 14 of the shaft 10 to perform the assembly.

Therefore, it is difficult to assemble each part into the long cylinder shaft 10, and there are problems that, if a sealing defect occurs in the writing instrument, it may be determined to be a defective product even when it operates well, and if other defect factors are contained in the writing instrument, there is no way to determine it to be a defective product.

Further, parts for sealing are located at the front end of the shaft 10, and since quality control of the parts for sealing and the protruding or retracting operation is difficult, these parts should be produced for each model, and thereby each part requires specific production facilities.

SUMMARY OF THE INVENTION

In consideration of the above-mentioned circumstances, it is an object of the present invention to provide an assembly structure of a writing instrument, in which a sealing module assembly having a pre-assembled module for sealing is detachably attached to a body of the writing instrument, such that a production process may be smoothly performed due to an assembly process of the sealing parts with a difficulty in assembling being previously performed, and defective parts may be separately processed when defects occur in each part due to the separation structure of the body and the sealing module assembly, thereby reducing a defective rate.

In order to accomplish the above object, according to the present invention, there is provided an assembly structure of a writing instrument, including: a body including a knock part installed therein to be operated by pushing, and a cartridge inserted into a hollow inside thereof; and a sealing module assembly which is detachably attached to a front end of the body, and has modules for sealing and operating installed inside thereof.

Preferably, the sealing module assembly includes: O-rings for sealing thereof; a holder installed therein with being closely contacted with the O-ring; a link installed inside of the holder; and a ball shutter pivotally coupled to the link so as to be pivoted according to forward movement thereof.

In addition, the holder, the link, and the ball shutter may be previously assembled in this order toward the front end of the body between two O-rings.

Further, the sealing module assembly may further include an air circulation hole formed inside of the front opening to circulate air with an outside.

Further, the sealing module assembly may be assembled to the body by fastening with a screw or tight fitting.

In accordance with the assembly structure of a writing implement according to the present invention, it is possible to separately process the defective parts when defects occur in each part due to the separation structure of the body and the sealing module assembly, thereby reducing a defective rate.

In addition, since the module for sealing is previously assembled to the sealing module assembly, productivity is improved and the defective rate in assembly is reduced.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a perspective view illustrating a conventional retractable type writing instrument;

FIG. 2 is a perspective view illustrating a writing instrument according to the present invention;

FIG. 3 is a partially cutaway perspective view illustrating a body and a sealing module assembly of the writing instrument according to the present invention;

FIG. 4 is a cross-sectional view illustrating the sealing module assembly of the writing instrument according to the present invention; and FIG. 5 is a view illustrating a state of use of the writing instrument according to the present invention.

DETAILED DESCRIPTION OF THE INVENTION

Hereinafter, an assembly structure of a writing instrument according to the present invention will be described in detail with reference to the attached drawings in terms of configuration and operation thereof.

In the drawings, FIG. 2 is a perspective view illustrating a writing instrument according to the present invention, FIG. 3 is a partially cutaway perspective view illustrating a body and a sealing module assembly of the writing instrument according to the present invention, FIG. 4 is a cross-sectional view illustrating the sealing module assembly of the writing instrument according to the present invention, and FIG. 5 is a view illustrating a state of use of the writing instrument according to the present invention.

As illustrated in FIG. 2, the writing instrument according to the present invention generally includes: a body 100 and a sealing module assembly 200 detachably attached to an end of the body. Herein, the body 100 may include a knock part 120 coupled to an upper end of the body 100 so as to make a nib 138 protrude from or be retracted into the body by a pushing operation thereof, and a cartridge 130 inserted inside thereof together with a spring 137. The sealing module assembly 200 may include first and second O-rings 210 and 220, a holder 230, a link 240, and a ball shutter 250.

First, the body 100 may be made of a synthetic resin material or a metallic material using an injection molding or a mold forming method, and may have a hollow pipe or tube shape.

Such a body 100 includes a rear opening 104 formed in one end thereof having an inner diameter size, into which components to be described below including the knock part 120 can be inserted and housed, and an opening formed in the other end thereof having a thread formed on an inner circumference, to which the sealing module assembly 200 is coupled by fastening with a screw or tight fitting.

In addition, a clip part 110 may be installed on a circumferential surface of the body at a position adjacent to the rear opening 104, which is coupled thereto for allowing a natural clipping or releasing operation thereof as a clip means therein.

The knock part 120, which is inserted into the rear opening 104 of the body 100 so as to make the nib 138 protrude from or be retracted into the body 100 by a pushing operation, may be positioned and installed inside of the rear opening 104 so as to transfer a force to the cartridge 130 by the pushing operation of a user, and has a tube shape having a small diameter circumferential surface and a large diameter circumferential surface formed in a layered structure. Herein, one end of the small diameter circumferential surface is opened and the other end of the large diameter circumferential surface is closed.

In addition, the cartridge 130 corresponds to an ink storage portion, and may have an internal volume of a predetermined capacity.

Such a cartridge 130 has a tank part 132 having a largest diameter, a connection part 133 having a relatively smaller diameter than the tank part 132, and a nib extension shaft part 134 having a relatively smaller diameter than the connection part 133, which are integrally formed therewith.

Further, the nib 138 is coupled to an end of the nib extension shaft part 134, so that any content (for example, ink) etc. stored in the tank part 132 may be supplied thereto by a common ink supply method (for example, a capillary phenomenon, pressure difference, suction, etc.) from the tank part 132 according to a common supply method corresponding to types of the writing instrument.

Meanwhile, the spring 137 is inserted on the nib extension shaft part 134, and then is placed on a stepped face of the connection part 133 near the tank part 132 so as to be supported thereby.

The spring 137 plays a role of pressing the cartridge 130 in an axial direction within a stroke distance of the cartridge 130 during the operation.

For example, when the cartridge 130 and the knock part 120 move in a forward direction by a predetermined stroke distance, the spring 137 is compressed while elastic energy is restored therein, which will act as an elastic restoring force when the spring returns from the compressed to an extended state. Herein, the predetermined stroke distance of the cartridge 130 is equal to the stroke distance of the knock part 120 or to a distance between an original position and a position where the nib 138 protrudes therefrom. In addition, when the cartridge 130 and the knock part 120 are in the released state in which they can return in a backward direction, the spring 137 plays a role of returning the components coupled to the cartridge 130 including the knock part 120 to the original position by the elastic restoring force thereof.

Herein, the sealing module assembly 200 will be described again with reference to FIGS. 2 to 4. The sealing module assembly 200 may be assembled to the body 100 by fastening with a screw or tight fitting. For this, the holder 230, the link 240 installed inside of the holder 230, and the ball shutter 250 which is pivoted according to forward movement of the link 240 are previously assembled in this order toward a front end of the body between two O-rings of the first and second O-rings 210 and 220.

The case of the sealing module assembly 200 may be made of a synthetic resin material or a metallic material, and may have a front opening 202 formed in one end thereof as a con-shaped hollow pipe.

In addition, the sealing module assembly 200 may further include an air circulation hole 203 formed inside of the front opening 202 to circulate air in a circumferential direction. The air circulation hole 203 may suppress an inside of the front opening 202 from becoming a vacuum state to maintain a smooth operation relationship.

The first and second O-rings 210 and 220 serve as a means for maintaining airtightness at inner circumferences of the sealing module assembly 200, and are made of any one material of rubber, silicone, and soft plastic, which are commonly used as a watertight means and/or an airtight means.

The first O-ring 210 may be installed on a side to which the body 100 is coupled, and the second O-ring 220 may be installed on a hemispherical face inside of the front opening 202 with being closely contacted therewith.

In addition, the holder 230, which is fixedly installed in the sealing module assembly 200 so as to be surrounded by the first O-ring 210, has a pair of penetrated hinge parts 232 formed to face each other on a front portion thereof as a hollow bushing. When the ball shutter 250 is coupled to the hinge parts 232, these hinge parts play a role of provide a stable support surface while allowing the ball shutter 250 to be pivoted.

In addition, it is preferable that the holder 230 has a rear portion having a diameter corresponding to the diameter of the first O-ring 210, and a locking groove 234 is formed therein on both sides at a predetermined length in a direction perpendicular to the hinge parts 232, thereby providing a guide line for a guide key 248 formed on the link 240 and defining a clearance space for elastic lugs 242, which will be described below.

Meanwhile, the link 240, which is slidably fitted in the holder 230, is provided for inserting the nib extension shaft part 134, and includes a pair of elastic lugs 242 formed at one end portion thereof facing the holder 230, which are cut and face each other with only one end being opened in the axial direction while maintaining a predetermined angle interval in the circumferential direction.

Further, the link 240 may have a cylindrical front end portion 244 integrally extending from the elastic lug 242 in the axial direction.

The front end portion 244 plays a role of rotating the ball shutter 250 in accordance with the forward movement. The front end portion 244 has protruded pins 246 formed at both sides thereof.

The pins 246 are inserted into pin slits 256 of the ball shutter 160 to be described below, such that the ball shutter 250 is pivoted by the forward movement of the link 240.

Meanwhile, the link 240 has the guide key 248 similar to a home plate shape found in baseball formed on the columnar surface between the elastic lug 242 and the front end portion 244, which is preferably formed on the same line on which the elastic lug 242 is formed.

As described above, the guide key 248 can move along the locking groove 234 of the holder 230.

The ball shutter 250 is pivotally coupled to the holder 230 to function as a door for allowing the nib to be moved forward or sealed according to the pivoting thereof. The ball shutter 250 has a through passage 252 formed therein in a substantially circular shape, which is open while passing through an axial center on both outer peripheral sides of the circular-shaped spherical face, and hinge shafts 254 formed on both sides thereof at outer central portions orthogonal to the through passage 252.

Further, the ball shutter 250 has the pin slits 256 formed to face each other at eccentric positions near the hinge shafts 254, which may be slantly formed toward the central portion. The pin slits 256 are provided at positions corresponding to pins 246 of the link 240 to be inserted therein, which will be described below, and the pin slits 256 inclined at the eccentric positions may be engaged with the pins 246, so as to play a role similar to a cam groove for converting a force generated by the forward movement of the link 240 to a force that pivots the ball shutter 250 within a rotational angle range of a limited magnitude.

Hereinafter, an operation of the assembly structure of a writing instrument according to the present invention having the above-described configuration will be described. First, the second O-ring 220 is pushed into the sealing module assembly 200, then the assembly of the holder 230, the link 240 and the ball shutter 250 are sequentially positioned, and the O-ring 210 is positioned by pushing.

Meanwhile, the cartridge 130 and the spring 137 are positioned in the body 100, and the knock part 120 is coupled thereto.

In this state, as illustrated in FIG. 5, the sealing module assembly 200, in which sealing parts are previously assembled by various models, may be assembled to the end of the body 100 by fastening with a screw or tight fitting.

Therefore, conventionally, since the body 100 and the sealing module assembly 200 are integrally formed with each other, when an operational failure or sealing defect occurs in the writing instrument, the entire writing instrument is discarded as a defective product, but in the present invention, since the sealing module assembly 200 is separately formed from the body, when a printing defect or operational failure occurs in the body 100, only the body 100 may be discarded, and when a sealing defect occurs, only the sealing module assembly 200 may be discarded.

In addition, due to the pre-assembled sealing module assembly 200, assemblability may be improved.

In order to perform a nib protruding operation in the writing instrument as described above, when the knock part 120 is pushed down to a very small stroke distance by a switch fixing operation or pushing operation of the knock part by the user, the knock part 120 and the cartridge 130 move forward as much as the stroke distance in the forward direction.

At this time, although the spring 137 is in the same state as described above, it applies a slightly increased spring elastic restoring force corresponding to the movement ratio to the cartridge 130, such that with the holder 150 being fixed, the cartridge 130 and the link 240 coupled thereto move as much as the stroke distance.

Herein, when the knock part 120 is further pushed down by the user as much as the predetermined stroke distance, the pin 246 of the moving forward link 240 slides along the inclined pin slit 256 of the ball shutter 250, such that the ball shutter 250 is rotated by the hinge shaft 254 which is pivotally positioned with being included in the hinge part 232 of the holder 230, and the guide key 248 of the link 240 moves along the locking groove 234 of the fixed holder 230.

Accordingly, the through passage 252 of the ball shutter 250 coincides with the cartridge 130 in the axial direction thereof to communicate with the front opening 202.

The nib 138 protrudes from the front opening 202 and is maintained in the protruding state. In this state, the user can use the writing implement of the present invention.

Meanwhile, when the user performs a nib retracting operation by releasing the clip part 110, the nib 138 in the protruded state may return to the original position inside of the body 100.

For this, the user pushes down the knock part 120 to move the clip part 110 backward in a direction in which the clip part 110 is released from the body 100.

Thereby, the compressed spring 137 is extended to move the knock part 120 and the cartridge 130 backward, and the nib retracting operation is performed in an order reverse to the nib protruding operation.

While the present invention has been described with reference to the preferred embodiments and modified examples, the present invention is not limited to the above-described specific embodiments and the modified examples, and it will be understood by those skilled in the related art that various modifications and variations may be made therein without departing from the scope of the present invention as defined by the appended claims, as well as these modifications and variations should not be understood separately from the technical spirit and prospect of the present invention.

DESCRIPTION OF REFERENCE NUMERALS

100: body, 104: rear opening
110: clip part, 120: knock part
130: cartridge, 132: tank part
133: connection portion, 134: nib extension shaft part
137: spring, 138: nib
200: sealing module assembly, 202: front opening
210, 220: first, second O-rings, 230: holder
232: hinge part, 234: locking groove

240: link, 242: elastic lug
244: front end portion, 246: pin
248: guide key, 250: ball shutter
252: through passage, 254: hinge shaft
256: pin slit

What is claimed is:

1. An assembly structure of a writing instrument, comprising:

a body including a knock part installed therein to be operated by pushing, and a cartridge inserted into a hollow inside thereof; and a sealing module assembly which is detachably attached to a front end of the body, the sealing module assembly including modules for sealing and operating installed inside thereof and an air circulation hole formed inside of the front opening to circulate air with an outside, wherein the sealing module assembly includes:

O-rings for sealing thereof;

a holder installed therein with being closely contacted with one of the O-ring;

a link installed inside of the holder; and a ball shutter pivotally coupled to the link so as to be pivoted according to forward movement thereof.

2. The assembly structure of a writing instrument according to claim 1, wherein the holder, the link, and the ball shutter are previously assembled in this order toward the front end of the body between two O-rings.

3. The assembly structure of a writing instrument according to claim 1, wherein the sealing module assembly is assembled to the body by fastening with a screw or tight fitting.

* * * * *